United States Patent [19]

Liuzza

[11] 4,060,954

[45] Dec. 6, 1977

[54] BAR CHAIR FOR REINFORCING RODS

[76] Inventor: James J. Liuzza, 3522 Latma, Houston, Tex. 77025

[21] Appl. No.: 303,604

[22] Filed: Nov. 3, 1972

[51] Int. Cl.[2] ..... E04C 5/20

[52] U.S. Cl. ..... 52/677; 52/169.1; 52/309.1; 52/678; 52/689

[58] Field of Search ..... 52/678, 685–687, 52/689, 169.1, 309.1; 211/60 R, 148; 248/49, 346

[56] References Cited

U.S. PATENT DOCUMENTS

| | | | |
|---|---|---|---|
| 2,808,788 | 10/1957 | Stough | 211/148 |
| 2,823,539 | 2/1958 | Kersh et al. | 52/678 |
| 3,289,379 | 12/1966 | Watts | 52/678 X |
| 3,387,423 | 6/1968 | Andersen | 52/678 |
| 3,523,667 | 8/1970 | Guerrero | 248/49 |
| 3,693,310 | 9/1972 | Middleton | 52/685 |
| 3,694,988 | 10/1972 | Skold | 52/678 |

FOREIGN PATENT DOCUMENTS

| | | | |
|---|---|---|---|
| 2,024,883 | 8/1971 | Germany | 52/686 |
| 169,180 | 10/1959 | Sweden | 108/91 |

*Primary Examiner*—Alfred C. Perham
*Attorney, Agent, or Firm*—Ranseler O. Wyatt

[57] ABSTRACT

A chair for supporting reinforcing bars having means for stacking one chair upon another to provide various sizes of chairs and for supporting a single layer of reinforcing bars or multiple layers of reinforcing bars, and having novel means for mounting the chair in soft bedding material such as sand, shell, gravel, mud or the like, which consists of a plate having upstanding studs to receive the tubular legs of the chairs.

1 Claim, 2 Drawing Figures

Fig. 1
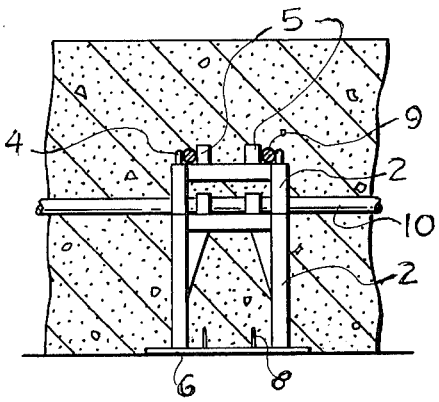
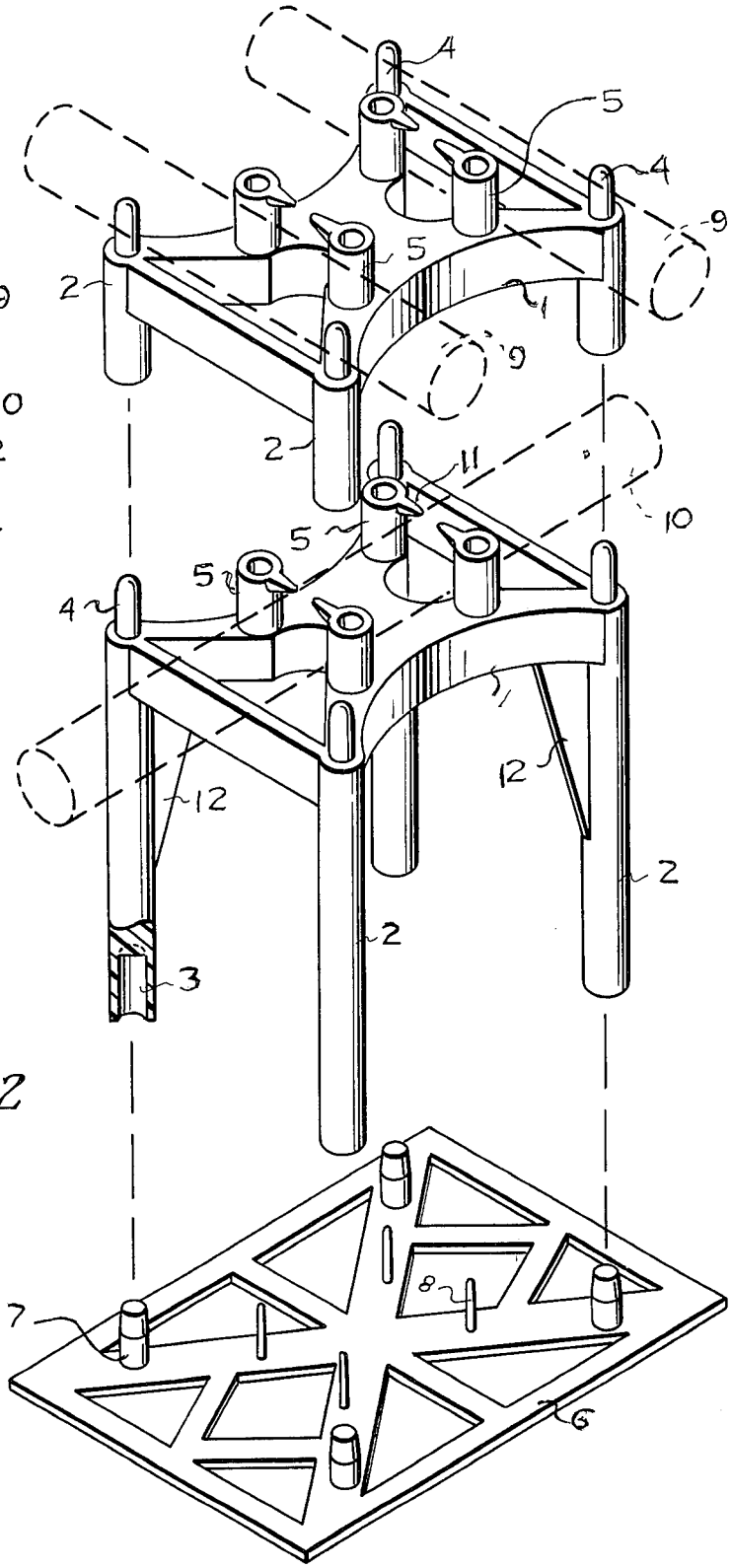
Fig. 2

BAR CHAIR FOR REINFORCING RODS

SUMMARY OF THE INVENTION

A bar chair for supporting reinforcing bars in concrete having tubular legs on one surface and upstanding studs on the other surface to permit stacking of the chairs, to support reinforcing rods at various levels or multiple layers of rods, and having a plate to mount the chair in soft beds to permit supporting of reinforcing rods without the legs of the chair sinking into the bed.

BRIEF DESCRIPTION OF THE DRAWING

FIG. 1 is a side elevational view of stacked chairs in concrete, supporting reinforcing bars, and FIG. 2 is an exploded view of the sand plate and chair, and showing a reinforcing rod in dotted lines mounted on said chair and an additional chair supporting another layer of reinforcing bars.

DESCRIPTION OF THE PREFERRED EMBODIMENT

In the drawings, the numeral 1 designates a substantially rectangular body of rigid material, such as polyethylene plastic, having the longitudinal sides concaved to reduce weight and material, and having four depending legs 2, 2 extending from the respective corners of the body 1 and the lower portion of said legs being tubular as at 3 forming a stud receiving chamber. On the upper surface of said body 1, and at each corner thereof, are the upwardly extending outer studs 4, 4 of a diameter to be snugly received by the chambers 3 in the tubular portion of the legs 2, 2 and on said upper surface of the body 1 are the inside studs 5, 5 having the upper portion thereof tubular.

A sand plate 6 consisting of a substantially rectangular flat platform, having upstanding studs 7, 8, is employed, the studs 7 being adapted to receive one size of chair, and the studs 8, being designed to receive another size. The studs 7 are arranged to receive the tubular portion of the legs of the chair to be mounted thereon. The studs 5, 5 have flexible, inwardly extending, lateral fingers 11, 11.

In use the chairs are made in several sizes, but each chair will snap into another chair, all of the studs and legs being in vertical alignment. Similarly, the studs of the sand plate are arranged to receive the tubular legs of the various chairs. The studs 4 and 5 are spaced apart to provide space for the various sizes of reinforcing bars, the bars 9, 9 which are usually the smaller bars, such as the ⅝ diameter bar, fit between the studs 4 and 5, while the one inch, or larger, bar, fits between the studs 5, 5, the chair being positioned one way to receive one size, and turned another way to receive larger bars, as shown in FIG. 2, and the mounting of the single bar 10 on the body 1 by forcing same past the flexible, lateral, inwardly extending fingers 11, 11 permits the bar to be snapped into place, to retain same on the chair, which will, in some instances, take the place of tying the rods on to the chair in the usual manner.

This structure permits the stocking by the supplier of a minimum number of sizes of chairs. For instance, where a customer wants five inch chairs, the four inch and one inch may be combined, as shown in FIG. 1, and the sand plate, by having the studs 7, 8, will receive all chairs, the studs 8 being used where very small chairs are needed, where only a relatively thin concrete slab is being poured. Where a criss-cross pattern of reinforcing rods is to be used, the bars may be placed on one chair in one direction and then an additional chair added on, and the bars placed in the opposite direction.

On chairs having long legs, it is desireable to add the inwardly directed braces 12, 12. In both the chairs and the sand plate, excessive material is cut away to provide a light chair, readily integrated into the concrete. By being formed of plastic, and the ends of the legs being flush with one outside surface of the slab, where tilt walls are being built, the ends of the legs will be exposed, but will not rust when the walls are sand blasted or exposed to the weather, as do the conventional metal chairs, thus eliminating unsightly marks on the walls or rust streaks after rain.

What I claim is:

1. In a bar chair for reinforcing rods, a substantially rectangular body, having a depending cylindrical leg at each corner and opposed, upstanding cylindrical studs, the lower portion of said depending legs being tubular and the upstanding studs forming guides for the reinforcing rods to be mounted on said chair, and being of a reduced diameter adapted to fit in said tubular portion of the depending legs and extend upwardly therein for vertical support, and a detachable sand plate comprising a flat base member adapted to lie on the sand bed of a concrete slab excavation, upstanding cylindrical studs on said base to be received by the tubular portion of said legs of the chair.

* * * * *